US006318214B1

(12) United States Patent
Buck

(10) Patent No.: US 6,318,214 B1
(45) **Date of Patent: *Nov. 20, 2001**

(54) POWER TONG POSITIONING APPARATUS

(76) Inventor: David A. Buck, 1348 Sawmill Hwy., Breaux Bridge, LA (US) 70517

( * ) Notice: Subject to any disclaimer, the term of this patent is extended or adjusted under 35 U.S.C. 154(b) by 0 days.

This patent is subject to a terminal disclaimer.

(21) Appl. No.: 09/603,754

(22) Filed: Jun. 26, 2000

Related U.S. Application Data

(63) Continuation-in-part of application No. 09/203,059, filed on Dec. 1, 1998, now Pat. No. 6,142,041.

(51) Int. Cl.[7] ..... B25B 13/50
(52) U.S. Cl. ..... 81/57.35; 81/57.16; 81/57.24
(58) Field of Search ..... 81/57.15, 57.16, 81/57.24, 57.33, 57.34, 57.35, 57.4; 166/66; 175/162

(56) References Cited

U.S. PATENT DOCUMENTS 3,803,953 * 4/1974 Geczy et al. ..... 81/57.35
4,202,225 * 5/1980 Sheldon et al. ..... 81/57.35
4,643,259 * 2/1987 Zeringue, Jr. ..... 166/77.5
5,390,568 * 2/1995 Pietras ..... 81/57.16
5,664,310 * 9/1997 Penisson ..... 29/407.02
5,667,026 * 9/1997 Lorenz et al. ..... 81/57.35
6,142,041 * 11/2000 Buck ..... 81/57.35

* cited by examiner

*Primary Examiner*—Joseph J. Hail, III
*Assistant Examiner*—David B. Thomas
(74) *Attorney, Agent, or Firm*—Jones, Walker, Weachter, Poitevent, Carrere & Denegre, LLP

(57) ABSTRACT

A power tong positioning apparatus positionable on the surface of drilling rig deck and attachable to at least one power tong. The power tong support is adapted to position at least one power tong so that it may engage a tubular member. The power tong positioning apparatus includes a frame, a base movably positioned on the frame, and a power tong support attached to the base and movably attachable to at least one power tong.

22 Claims, 14 Drawing Sheets

POWER TONG POSITIONING APPARATUS

RELATED APPLICATIONS

This application is a continuation-in-part of application Ser. No. 09/203,059, filed on Dec. 1, 1998, U.S. Pat. No. 6,142,041.

BACKGROUND OF THE INVENTION

1. Field of the Invention

This invention relates to power tong assemblies used to grip drill pipe and other similar tubular members. More particularly, this invention relates an apparatus that can safely and effectively position a power tong assembly for engagement with tubular members.

2. Prior Art

Pipe tongs are often employed in the oil and gas industry to break apart or tighten together threaded tubular member connections. It is generally required that one set of pipe tongs grip and rotate one section of tubular member and one set of pipe tongs grip and hold stationary the other section of tubular member. Modem drilling operations usually employed powered pipe tongs, or power tongs. The first tong rotating the tubular member is referred to as the power tong, while the second tong holding the tubular member stationary is referred to as, the back-up power tong. Suitable power tongs can include devices such as those disclosed in U.S. Pat. Nos. 5,671,961, 5,819,604, and 5,702,139 to Buck, which are incorporated herein by reference.

Presently, when power tong assemblies are placed into operation, they are suspended from cables as shown in FIG. 1. When lengths of tubular members are joined ("made-up") or disconnected ("broken"), a power tong 3 engages and grips a first tubular member 1 and a back-up power tong 4 engages and grips a lower tubular member 2. As power tong 3 grips and rotates upper tubular member 1 and back-up power tong 4 grips and holds stationary lower tubular member 2, upper tubular member 1 is either forced toward or away from lower tubular member 2 by action of the corresponding threads on tubular members 1, 2.

Often when running larger diameter tubulars, a power tong may be used without a back-up power tong. In such an operation, the power tong is suspended from a cable similar to that shown in FIG. 1. To prevent rotation of the power tong and to hold the power tong in position horizontally, one or more cables may be anchored onto the drilling rig itself and connect to the power tong. This type of operation can be dangerous should one of the supporting cable break during operation.

Power tongs are bulky and heavy tools, with larger tongs weighing as much as 2,300 pounds and even smaller tongs weighing 1,500 to 1,800 pounds. Because of the size and bulk, three or more operators may be needed to position the power tong so that the tongs can grip the tubular members. Because the tongs are suspended from cables, they may swing freely and could potentially strike the nearby operators if not properly handled. What is needed in the art is a device that can reduce the number of operators required to effectively handle the power tong, while at the same time addressing the safety concerns associated with suspending the power tong from cables.

OBJECTS OF THE INVENTION

With the aforementioned considerations in mind, it is therefore an object of this invention to provide a positioning assembly for power tongs that eliminates the need for numerous operators to position the power tongs around the drill pipe.

It is a further object of this invention to provide a positioning assembly for power tong that eliminates the need to suspend the power tongs from a cable.

It is a further object of this invention to provide a safe and economical method for making up and breaking tubular member joints during drilling operations.

These and other advantages and objects of this invention shall become apparent from the ensuing description of the invention.

SUMMARY OF THE INVENTION

The invention disclosed herein is a power tong positioning apparatus positionable on the surface of drilling rig deck and attachable to at least one power tong. The power tong support is adapted to position at least one power tong so that it may engage said tubular member. The power tong positioning apparatus includes a frame, a base movably positioned on the frame, and a power tong support attached to the base and movably attachable to at least one power tong.

DETAILED DESCRIPTION OF PREFERRED EMBODIMENTS OF THE INVENTION

Illustrative preferred embodiments of the invention and preferred methods for construction and design of the invention are set forth below with specific references to the Figures. It is not the intent of the inventors that the scope of the invention be limited to these preferred embodiments.

Figure 2A:
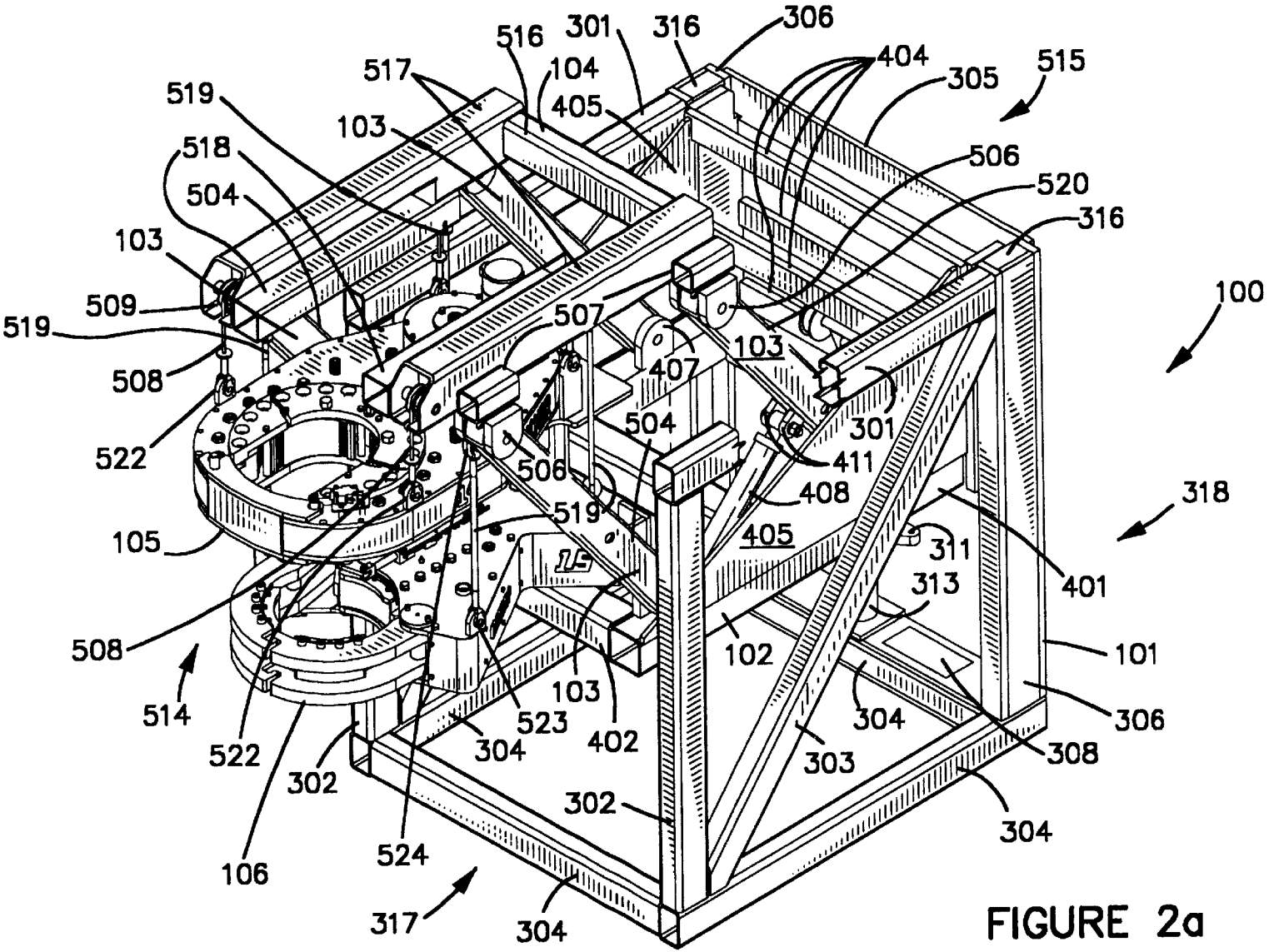
FIG. 2*a* illustrates an embodiment of the invention with the tongs in a raised and extended position where the support is pivotally attached to the base.
Figure 2B:
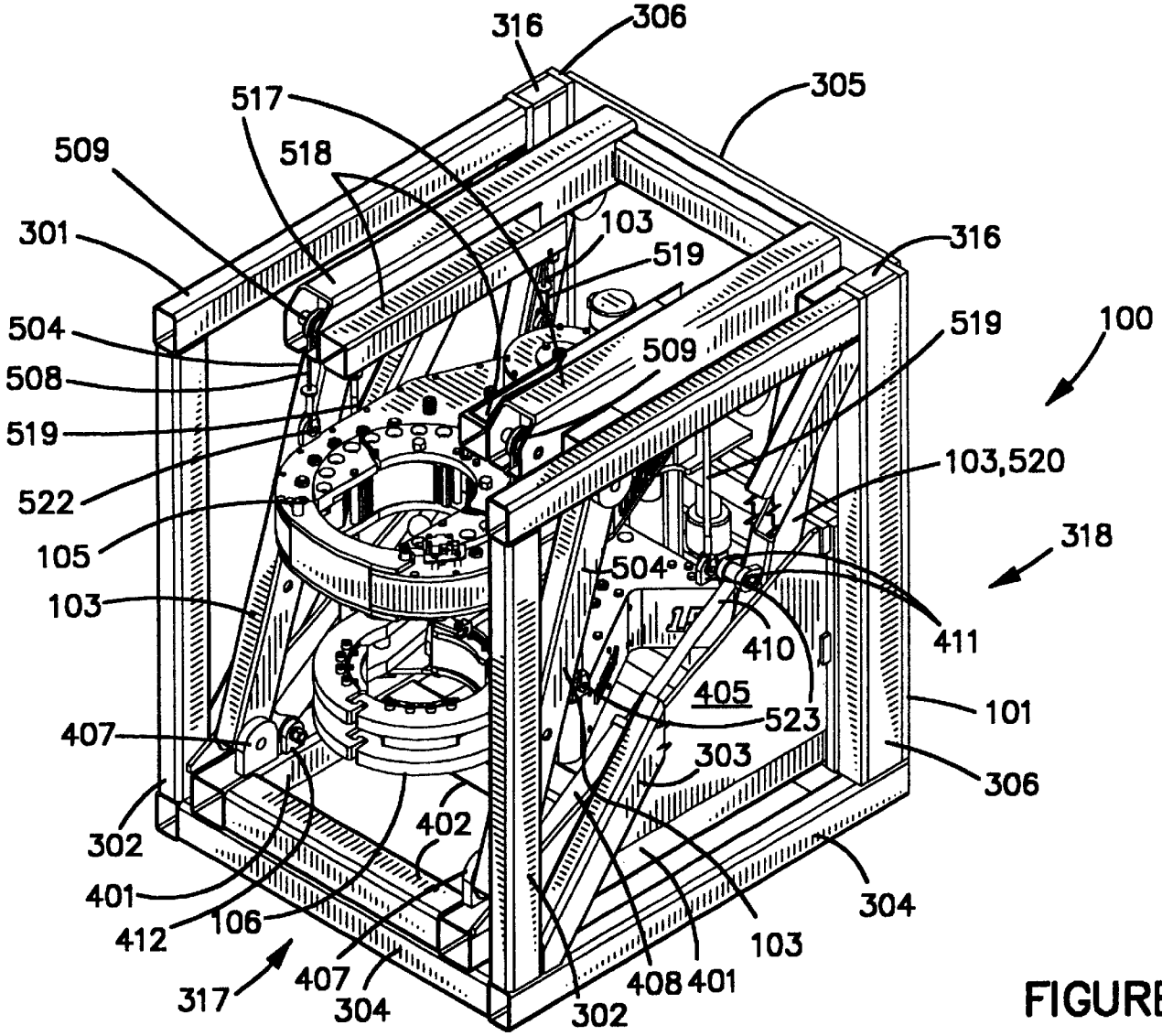
FIG. 2*b* illustrates the embodiment shown in FIG. 2*a* with the tongs in a lowered and retracted position where the support is pivotally attached to the base.
Figure 4:
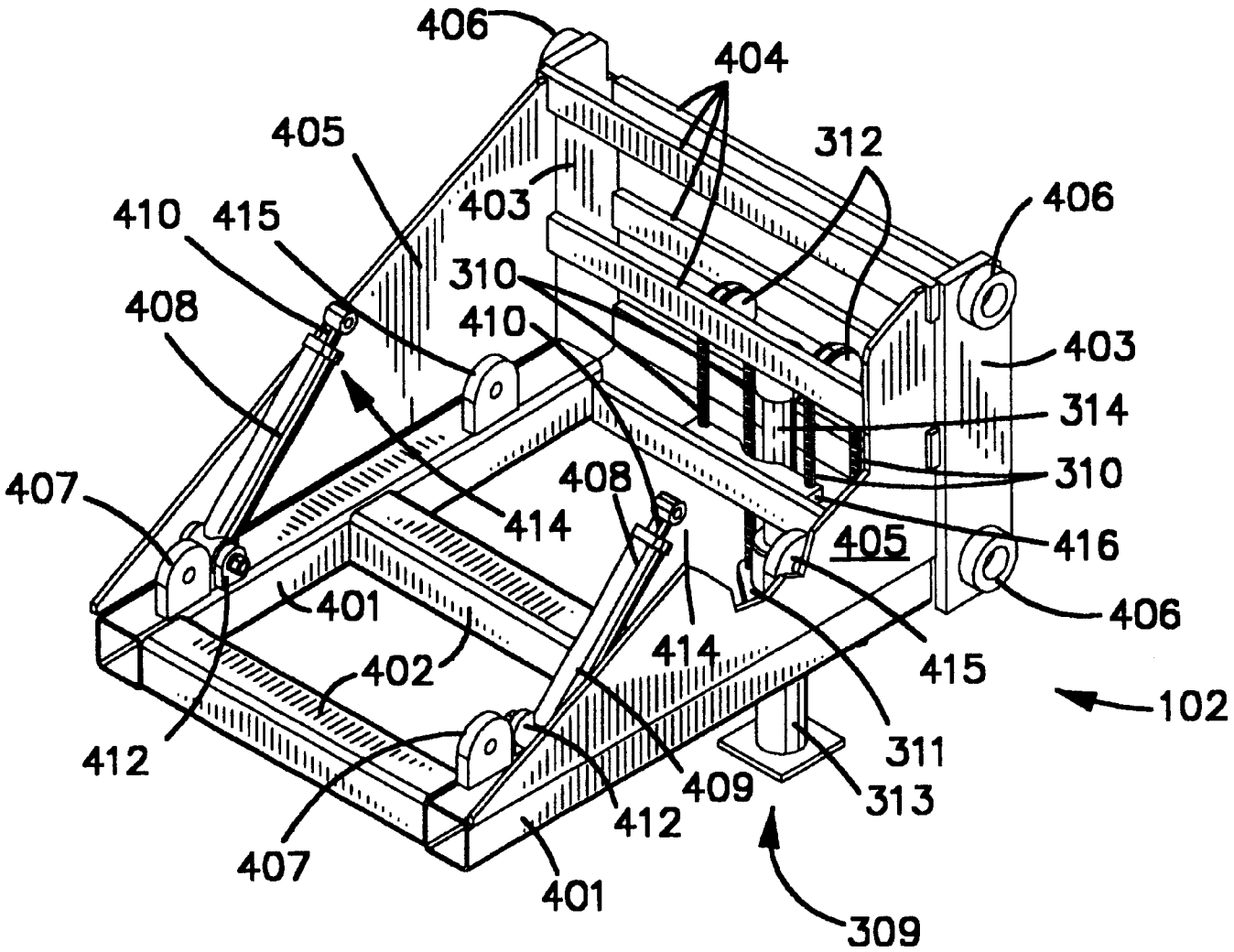
FIG. 4 illustrates the base used in the embodiment shown in FIGS. 2*a* and 2*b*.
Figure 5:
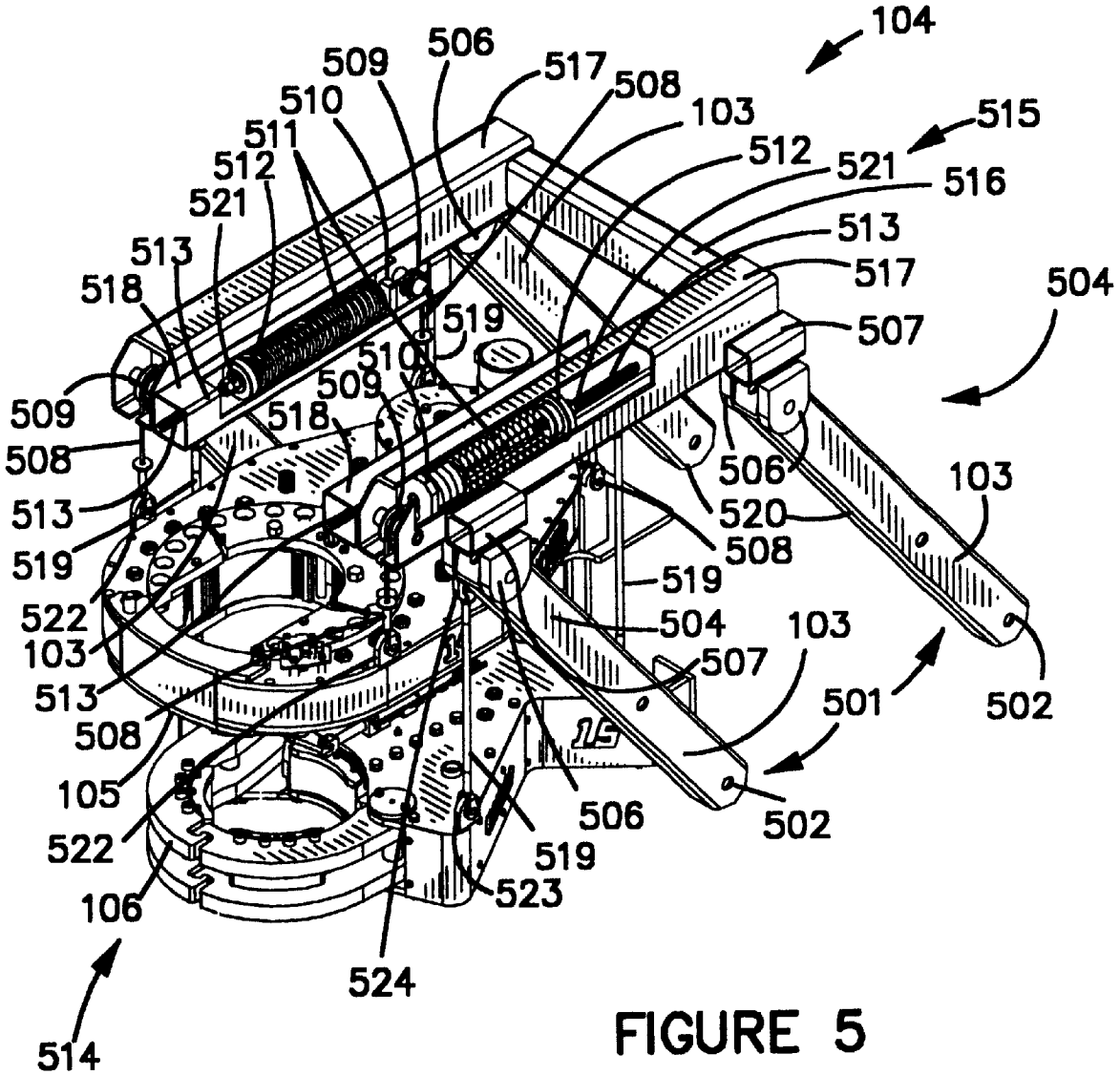
FIG. 5 illustrates the arm connections and the power tong support connections to the power tong and back-up power tong.

As shown in FIGS. 2*a*, and 2*b*, power tong positioning apparatus 100 generally comprises a frame 101 to which a base 102 is movably attached (base 102 is better seen in FIG. 4). As disclosed below, base 102 moves vertically from a lowered position shown in FIG. 2*b* to a raised position shown in FIG. 2*a*. One or more arms 103 pivotally attach to base 102, and four arms 103 are preferred. Arms 103 are shown extended in FIG. 2*a* and retracted in FIG. 2*b*. Arms 103 pivotally attach at upper end 504 to power tong support 104 as shown in FIGS. 2*a* and 5. Power tong support 104 allows power tong 105 and back-up power tong 106 to movably mount onto and be suspended from support 104. In a preferred embodiment, positioning apparatus 100 adjusts power tong 105 and back-up power tong 106 both horizontally and vertically up to 3 feet in either direction. Other embodiments may adjust tongs 105, 106 greater or lesser distances, depending on user specifications.

During operation, frame 101 is positioned on a deck adjacent to the sections of tubular members, such as drill pipe, to be gripped by power tong 105 and back-up power tong 106. As constructed, back-up power tong 106 pivotally connects to support 104 so that little or no vertical movement of back-up power tong 106 can occur relative to support 104. As discussed below, the use of spring/cable-mounted power tong 105 allows vertical movement of power tong 105 to prevent exertion of excessive vertical forces on the jaws of the tongs 105, 106.

Figure 3:
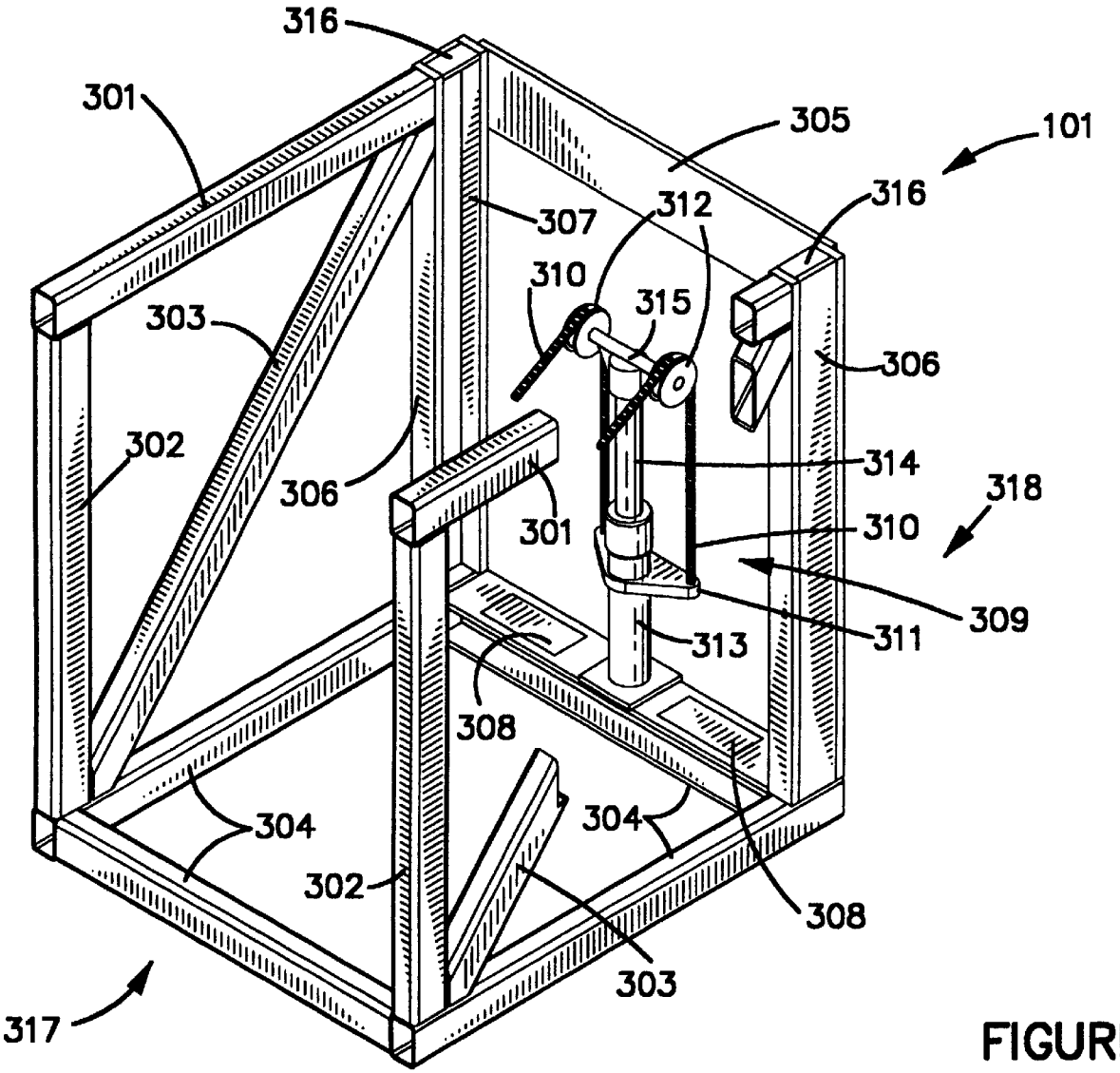
FIG. 3 illustrates the frame and lift apparatus used to raise and lower the power tongs.

As seen most clearly in FIG. 3, box-like frame 101 is constructed from floor beams 304 which are connected to each other and connected to vertical beams 302 near front 317 and to vertical beams 306 at rear 318. Diagonal cross beams 303 extend from the lower end of vertical beams 302 near front 317 to the upper end of vertical beams 306 to provide additional support to frame 101. The upper portion of frame 101 near front 317 is open. Horizontal beams 301 extend along the upper portion of frame 101 between vertical beams 302 and vertical beams 306. A rear upper beam 305 extends between the upper ends of vertical beams 306. One or more magnets 308 may attach to, or be incorporated as part of, floor beam 304 to engage the drilling deck surface, which will be constructed at least partly with a magnetic material such as steel. Magnets 308 anchor frame 101 onto the deck surface to prevent positioning apparatus 100 from tipping over when tongs 105, 106 engage a tubular member. In an embodiment not shown in the Figures, magnets 308 may be pivotally connected to floor beam 304 so that magnets 308 may fold out from frame 101 and engage a drilling rig deck. Additional anchoring devices and methods well known in the art are also acceptable. The components of frame 101 are preferably constructed from 3×6 inch rectangular tubing material.

Vertical beams 306 have guides 307 constructed therein which allow rollers 406 on base 102 (shown in FIG. 4) to roll within guides 307 when base 102 is raised and lowered within frame 102. Vertical beams 306 have a stopper 316 to prevent rollers 406 from exiting guides 307 thereby preventing base 102 from disengaging frame 101. In a preferred embodiment, guides 307 are constructed to be 8 inches wide and 3 inches deep.

Lift apparatus 309 attaches to floor beam 304 to raise and lower base 102. Lift apparatus 309 is a hydraulic cylinder which includes a pair of telescoping cylinders 313, 314 positionable between cross beams 404 on base 102 (better seen in FIG. 4). While not shown, a fluid carrying hose could be connected to cylinder 313 so that cylinder 314 is raised or lowered using hydraulic power. Other power mechanisms well known in the art would also work. Attached to cylinder 314 is cross arm 315 which has pulleys 312 attached at both ends. Connected to cylinder 313 is plate 311. One or more chains 310 attach to plate 311, extend around pulleys 312, and connect to base 102 as shown in FIG. 4, preferably to one or more cross beams 404 using a spacer 416 or other suitable means. Referring back to FIG. 3, when cylinder 314 telescopes out of cylinder 313, chains 310 exert an upward force on base 102, thereby raising base 102. When cylinder 314 retracts into cylinder 313, base 102 is thereby lowered. Other devices well known in the art may also be incorporated into the invention 100 as a lift apparatus 309.

Referring to FIG. 4, base 102 comprises a pair of cross beams 402 having horizontal beams 401 connected on both sides. Gussets 405 are connected to each horizontal beam 401 and to vertical beams 403. Vertical beams 403 have one or more cross beams 404 extending therebetween. One or more rollers 406 attach to each vertical beam 403 and are sized to fit within guides 307 on vertical beams 306 (see FIG. 3). Rollers 406 act as low friction guides when base 102 is raised or lowered by lift apparatus 309. Rollers 406 are roller bearings constructed from regular steel or another suitable material.

Attached to horizontal beams 401 are front eyes 407 and rear eyes 415 which allow arms 103 to pivotally attach to base 102 using pins, nuts and bolts, or other suitable means known in the art as shown in FIGS. 2*a* and 2*b*. Referring back to FIG. 4, hydraulic cylinder 408 pivotally attaches to eyes 412 on horizontal beams 401 at lower end 409. Each hydraulic cylinder 408 further includes a rod 410 that telescopically engages cylinder 408 at upper end 414 and pivotally connects to rear arms 520 using eyes 411 as seen in FIGS. 2*a* and 2*b*. When rods 410 extend from cylinder 408, arms 103 are positioned as shown in FIG. 2*b*. When rods 410 fully retract, arms 103 are positioned as shown in FIG. 2*a*. While not shown, a fluid carrying hose could be connected to cylinder 408 so that rod 410 extends and retracts using hydraulic power. Other power mechanisms well known in the art are also acceptable.

Referring to FIGS. 2*a*, 2*b* and 5, arms 103 are constructed with an aperture 502 therein near lower end 501 which allow arms 103 to pivotally connect to base 102 at front eyes 407 and rear eyes 415 using pins, nuts and bolts, or other suitable means known in the art. FIG. 5 illustrates how arms 103 pivotally connect to power tong support 104 at upper end 504 using eyes 506 attached to brace 507 which is fixedly attached to support 104. Arms 103 could also pivotally attach directly to front mounting members 517 as long as arms 103 do not interfere with the movement of tongs 105, 106.

Still viewing FIG. 5, support 104 is constructed from a pair of front mounting members 517 connected by cross beam 516 at rear 515. Rear mounting members 518 attach to front mounting members 517, but mounting members 517, 518 could be incorporated into a single member in embodiments not shown in the Figures.

Back-up power tong 106 is pivotally suspended from support 104 by one or more rigid rods 519 which pivotally attach to back-up power tong 106 at eyes 523 and which pivotally attach to support 104 at eyes 524 connected to support 104 or connected to eyes 506. Rods 519 pivotally mount on support 104 and pivotally connect to back-up power tong 106 to allow slight movement of back-up power tong 106. This slight movement is preferred so that back-up power tong 106 may properly engage and grip tubular members. Rods 519 are positioned so as to avoid interference with the movement of power tong 105 and arms 103. Rods 519 are constructed from a rigid material, preferably round bar steel having a 1.5-inch diameter.

Figure 7:
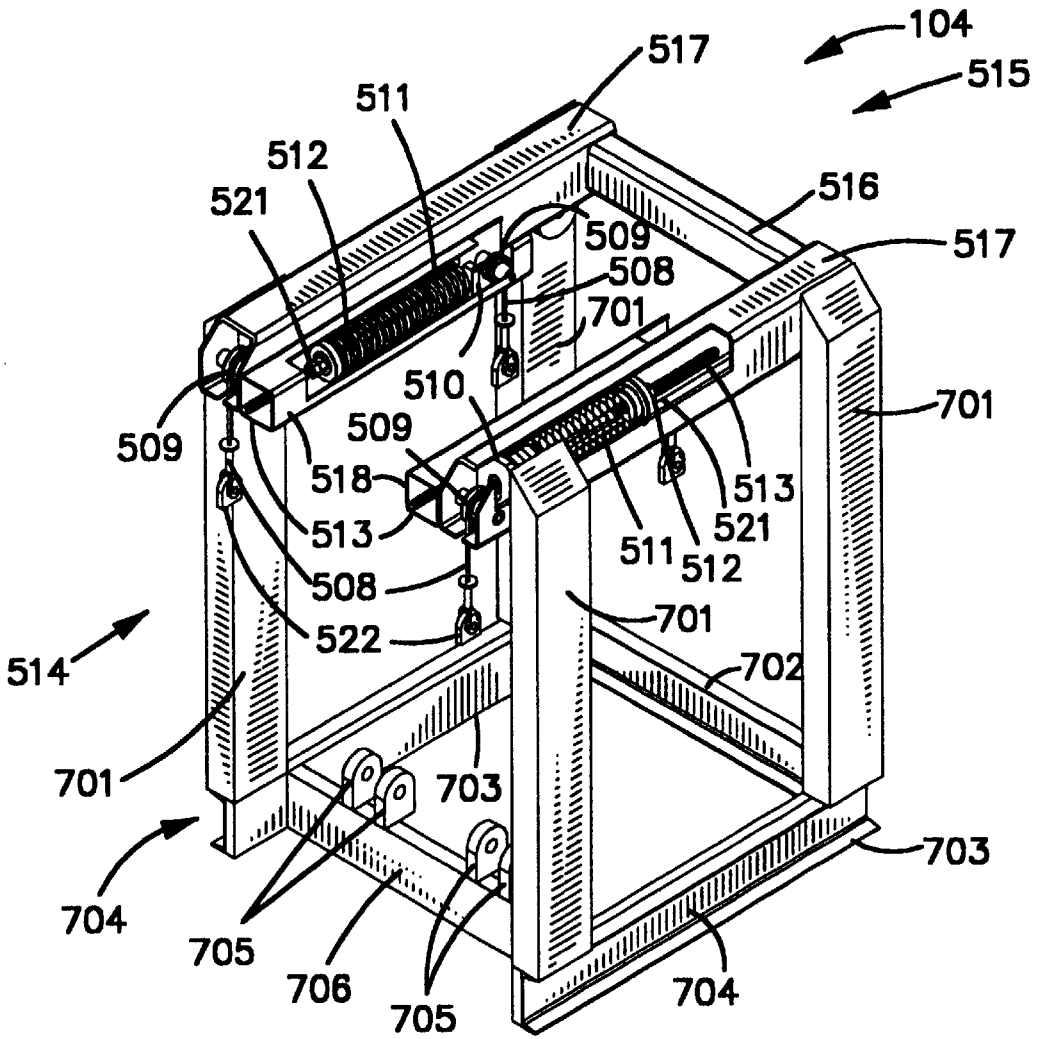
FIG. 7 illustrates the power tong support used in connection with the embodiment shown in FIGS. 6*a* and 6*b* with the power tong removed.

Referring to FIGS. 5 and 7, power tong 105 is suspended from support 104 by cables 508 which attach to eyes 522 mounted on power tong 105. One or more cables 508, preferably four cables 508 (two at front 514 and two at rear 515), pivotally attach to power tong 105 and extend upward into mounting members 517, 518. Cables 508 positioned at front 514 extend into respective front mounting members 517, while cables 508 positioned at rear 515 extend into respective rear mounting members 518. Within the mounting members 517, 518, cables 508 extend over pulleys 509, extend through stop plate 510, and connect to rods 513 using a swage or other suitable means. Rods 513 have a threaded end opposite the end connected to cable 508 to allow a nut 521 to engage rod 513 and position a washer 512. A spring 511 is positioned over rod 513 and extends between plate 510 and washer 512. One or more nuts 521 then attach to rod 513 at a predetermined position to securely hold all components in place, thereby suspending power tong 105. The "at rest" position of power tong 105 is adjusted by adjusting the positioning of nut 521 on rod 513.

For example, if two tubular members are to be connected, power tong 105 grips and rotates an upper tubular member while back-up power tong 106 grips and holds a lower tubular member stationary. As the upper tubular member rotates and engages the lower tubular member, the upper tubular member is forced downward. To minimize the vertical forces applied to the jaws of tongs 105, 106, power tong 105 moves vertically. In the above example, if power tong 105 moves downward, cables 508 force tension against springs 511 via washer 512, thereby allowing cables 508 to extend. If power tong 105 moves upward, springs 511 exert a force on washer 512 and nut 521, forcing retraction of cables 508 and removing the full weight of power tong 105 from the jaws. In either case, springs 511 allow power tong 105 to return to its "at rest" position when power tong 105 releases the upper tubular member.

The size and type of cables 508 and springs 512 will be dictated by type and size of tongs 105, 106. In the embodiment shown in the Figures for examples, cables 508 are constructed from stainless steel, having a ⅜ inch diameter while springs 512 are 4 inches in diameter and have a force constant of about 175 pounds per inch.

Figure 6A:
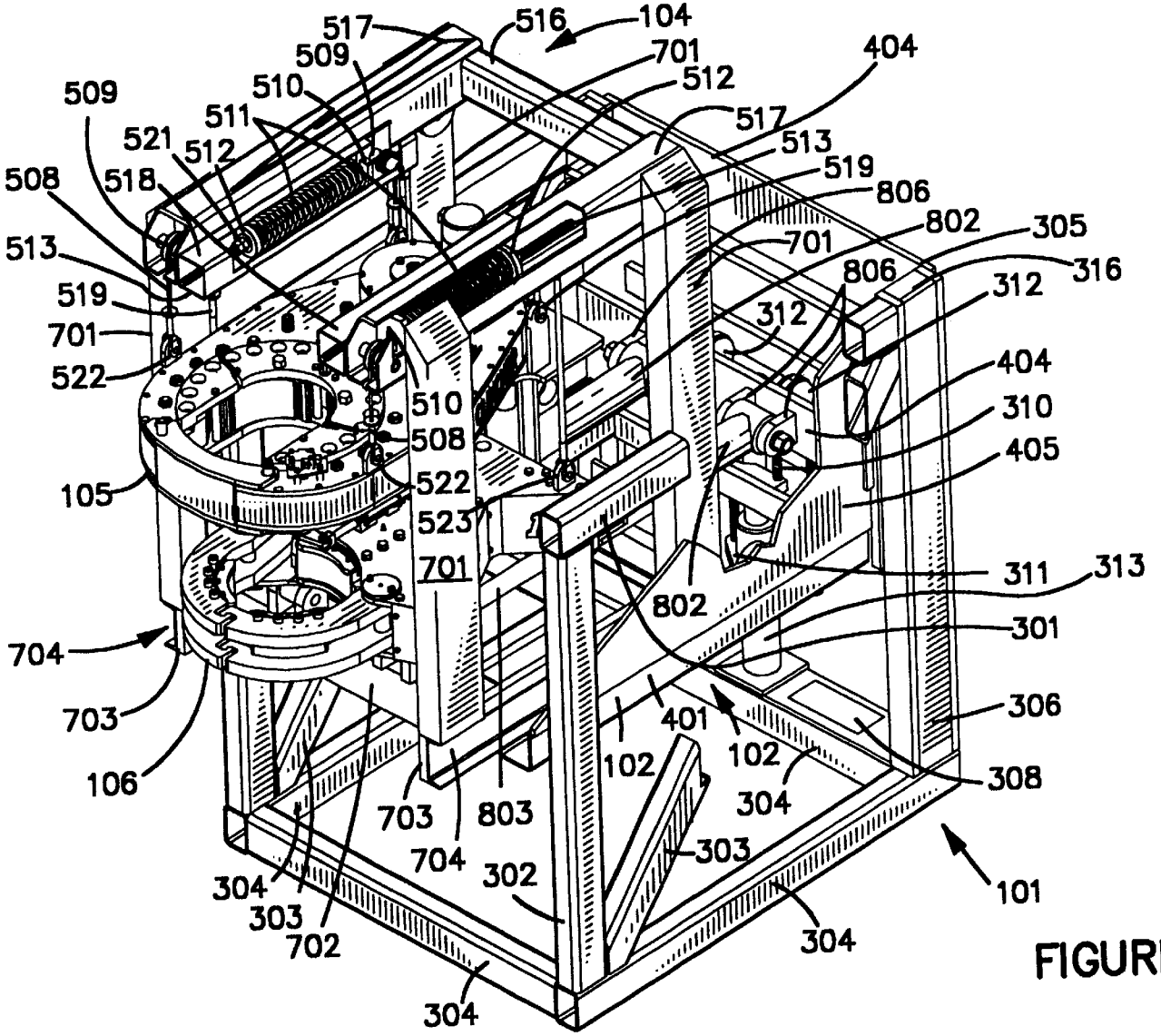
FIG. 6*a* illustrates an alternate embodiment of the invention where the support travels horizontally on the base and the tongs are in a raised and extended position.
Figure 6B:
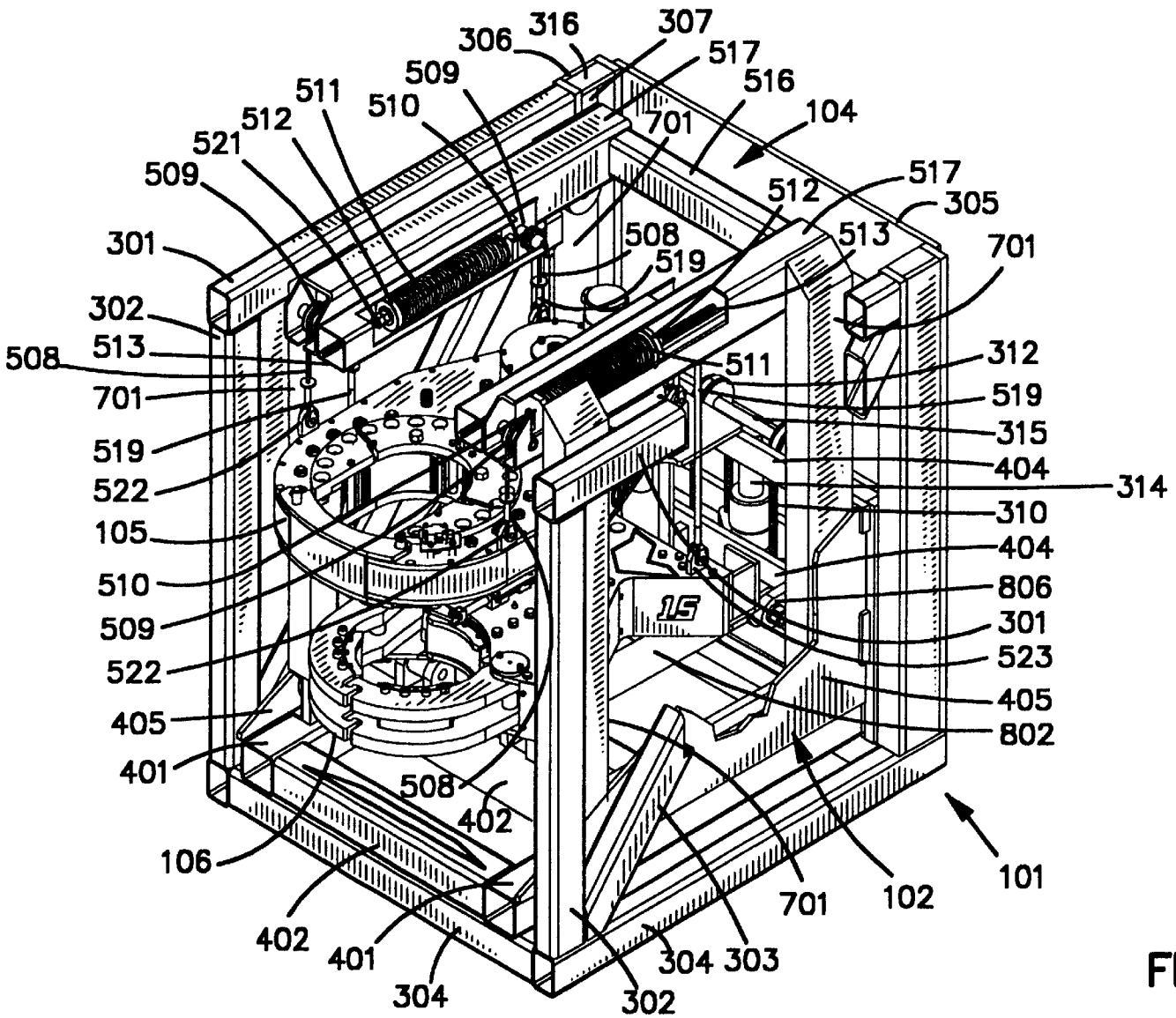
FIG. 6*b* illustrates the embodiment shown in FIG. 6*a* with the tongs in a lowered and retracted position.

In another embodiment shown in FIGS. 6*a* and 6*b*, support 104 is horizontally positionable on base 102 as described below. As shown, power tong positioning apparatus 100 generally comprises a frame 101 to which base 102 is movably attached (base 102 is seen bitter in FIG. 8). Base 102 moves vertically from a lowered position shown in FIG. 6*b* to a raised position shown in FIG. 6*a*. Support 104 moves from a retracted position shown in FIG. 6*b* to an extended position. Support 104 is shown as partially extended in FIG. 6*a*. One or more beams 701 connect support 104 to horizontal beams 703. Horizontal beams 703 have a slot 704 that mates with rollers 801 on base 102 (seen in FIG. 8) so that support 104 is horizontally extendable from base 102. Extension apparatus 807 is better seen in FIG. 8. In a preferred embodiment, positioning apparatus 100 adjusts power tong 105 and back-up power tong 106 both horizontally and vertically up to 3 feet in either direction. Other embodiments may adjust tongs 105, 106 greater or lesser distances, depending on user specifications.

Figure 8:
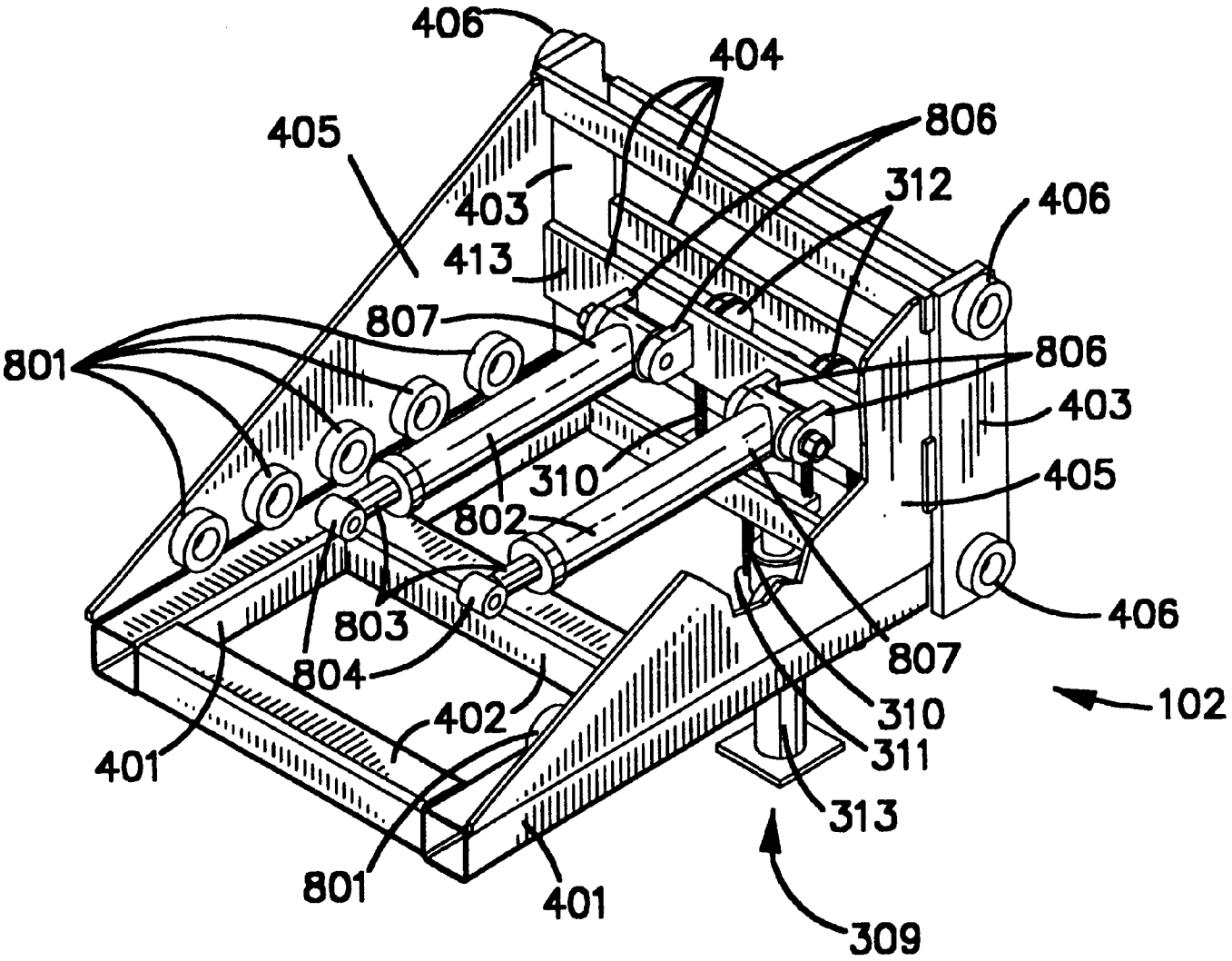
FIG. 8 illustrates the base used in the embodiment shown in FIGS. 6*a* and 6*b*.

As shown in FIG. 7, support 104 further includes four beams 701 connected to front mounting members 517. Beams 701 connect to horizontal beams 703, which have cross beams 702, 706 positioned therebetween. Each horizontal beam 703 is configured to have a slot 704 that one or more rollers 801 engage when positioning apparatus 100 is in operation. Eyes 705 are positioned on front cross beam 706 and allow extension apparatus 807 to horizontally position support 104. Base 102, as used in the embodiments shown in FIGS. 6*a* and 6*b*, is shown in FIG. 8. Base 102 comprises a pair of cross beams 402 having horizontal beams 401 connected on both sides. Gussets 405 are connected to each horizontal beam 401 and also to vertical beams 403. Vertical beams 403 have one or more cross beams 404 extending therebetween. One or more rollers 406 attaches to each vertical beam 403. Rollers 406 are sized to fit within guides 307 on vertical beams 306 (see FIG. 3). Rollers 406 act as low friction guides when base 102 is raised or lowered by lift apparatus 309.

Attached to cross beam 413 are two pairs of eyes 806. Extension apparatus 807 attaches to eyes 806 and extends and retracts support 104. Extension apparatus 807 includes a cylinder 802 and a rod 803 telescopically engaging cylinder 802. At end 804, rod 803 connects to front cross beam 702 at eyes 705. One or more rollers 801 attach to the inside wall of both gussets 405 with five rollers being preferred. While not shown, a fluid carrying hose could be connected to cylinder 802 so that rod 803 extends and retracts using hydraulic power. Other power mechanisms well known in the art would also work. When rod 803 extends from cylinder 802, rod 803 exerts a horizontal force on base 102, causing beams 703 to travel along rollers 801, thereby horizontally extending support 104 from base 102. When rod 803 retracts into cylinder 802, support 104 is retracted. Other devices well known in the art may also be incorporated into the invention 100 as an extension apparatus 807. Rollers 801 are sized to be positionable within slots 704 and are roller bearings constructed from steel or another suitable material.

In use, the invention 100 is placed on the deck of a drilling rig so that drill pipe, or other similar tubular member, is engageable by power tong 105 and back-up power tong 106. First, base 102 is raised to a desired height so that the ends of the tubular members are substantially positioned between power tong 105 and back-up power tong 106. In the embodiments shown in FIGS. 2*a* and 2*b*, arms 103 extend with power tong 105 and back-up power tong 106 in the open position (not shown) until the tongs 105, 106 engage the respective tubular members. In the embodiments shown in FIGS. 6*a* and 6*b*, support 104 is extended with power tong 105 and back-up power tong 106 in the open position (not shown) until the tongs 105, 106 engage the respective tubular members.

The height of base 102 may be adjusted, if needed, so that tongs 105, 106 properly grip the tubular members. Tongs 105, 106 are closed and grip the tubular members. Power tong 105 rotates the upper tubular member until the tubular members are completely joined or disconnected. In applications where larger tubular members are worked, it may be unnecessary to use a back-up power tong 106 because the drill string below the tubular member joint being worked may have sufficient stationary inertia to resist the torque applied when making or breaking the tubular member joint.

The use of the present invention allows remote use of positioning apparatus 100 without the need for multiple operators. Unlike the prior art methods and devices, once positioning apparatus 100 has been placed near the drill string, one operator can extend and adjust the height of the power tongs. The use of one operator is possible because the positioning of base 102 and support 104 is hydraulically controlled and because the tongs 105, 106 use hydraulic power to grip and rotate the tubular members. Thus, one operator, instead of three, can operate the present invention—a much more efficient use of manpower.

Though not shown in the Figures, other embodiments of positioning apparatus 100 may have support 104 directly attached to frame 101 or attached to frame 101 using one or more arms 103 so that support 104 attaches, either fixedly or pivotally, to frame 101. Support 104 could be vertically positionable on frame 101 using a lift apparatus 309. Support 104 could include a means for extending tongs 105, 106 into engagement with a tubular member. Tongs 105, 106 would connect to support 104 as previously described.

In other embodiments not shown in the drawings, extension apparatus 807, or a suitable equivalent, may be positionable between frame 101 and base 102 so that base 102 is horizontally positionable. In such an embodiment, lift apparatus 309 or a suitable equivalent, could be positioned on base 102 so that support 104 may be raised or lowered.

Though the invention has been described in terms of a frame 101, a base 102 and a support 104, "power tong support assembly" includes embodiments which comprise a frame, a base, a support, or any combination thereof constructed as a single unit positionable on the surface of a drilling rig deck and which can vertically and horizontally position one or more power tongs. For example, in FIGS. 2*a*, 2*b*, 6*a* and 6*b*, one could consider a power tong support assembly as comprising base 102 and support 104. As used in the claims, "at least one power tong" could include either a power tong 105, a back-up power tong 106 or a combination thereof.

Figure 1:
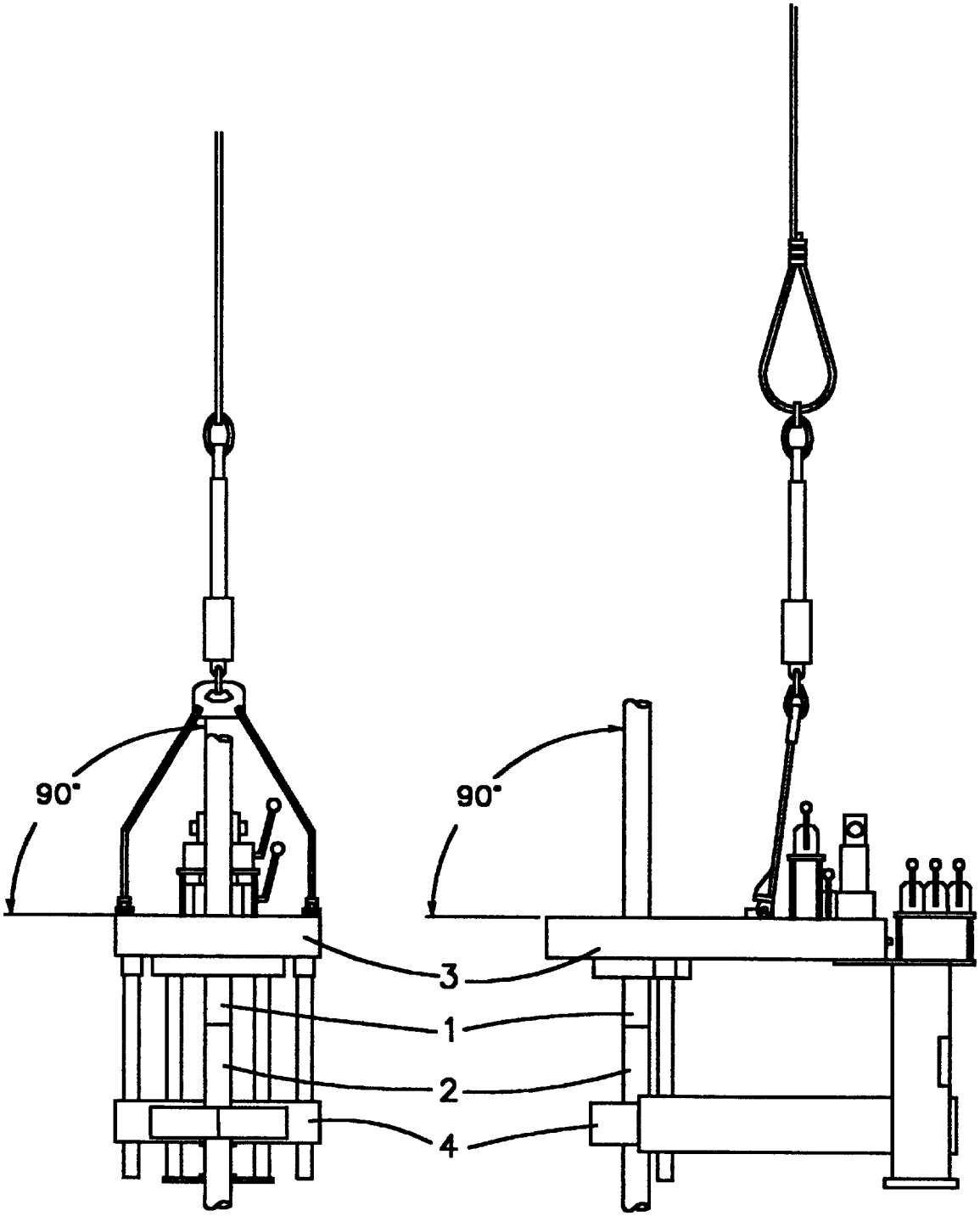
(PRIOR ART) FIGURE 1
FIG. 1 illustrates the prior means used to support one or more power tongs.

Another embodiment of the invention is shown in FIGS. 9–12 where the invention is used to horizontally position a power tong 105 or a back-up power tong 106 which has been suspended from cables similar to that shown in FIGS. 1*a* and 1*b*. As discussed above, the cables are used to vertically position the power tongs relative to the tubular members.

Figure 9:
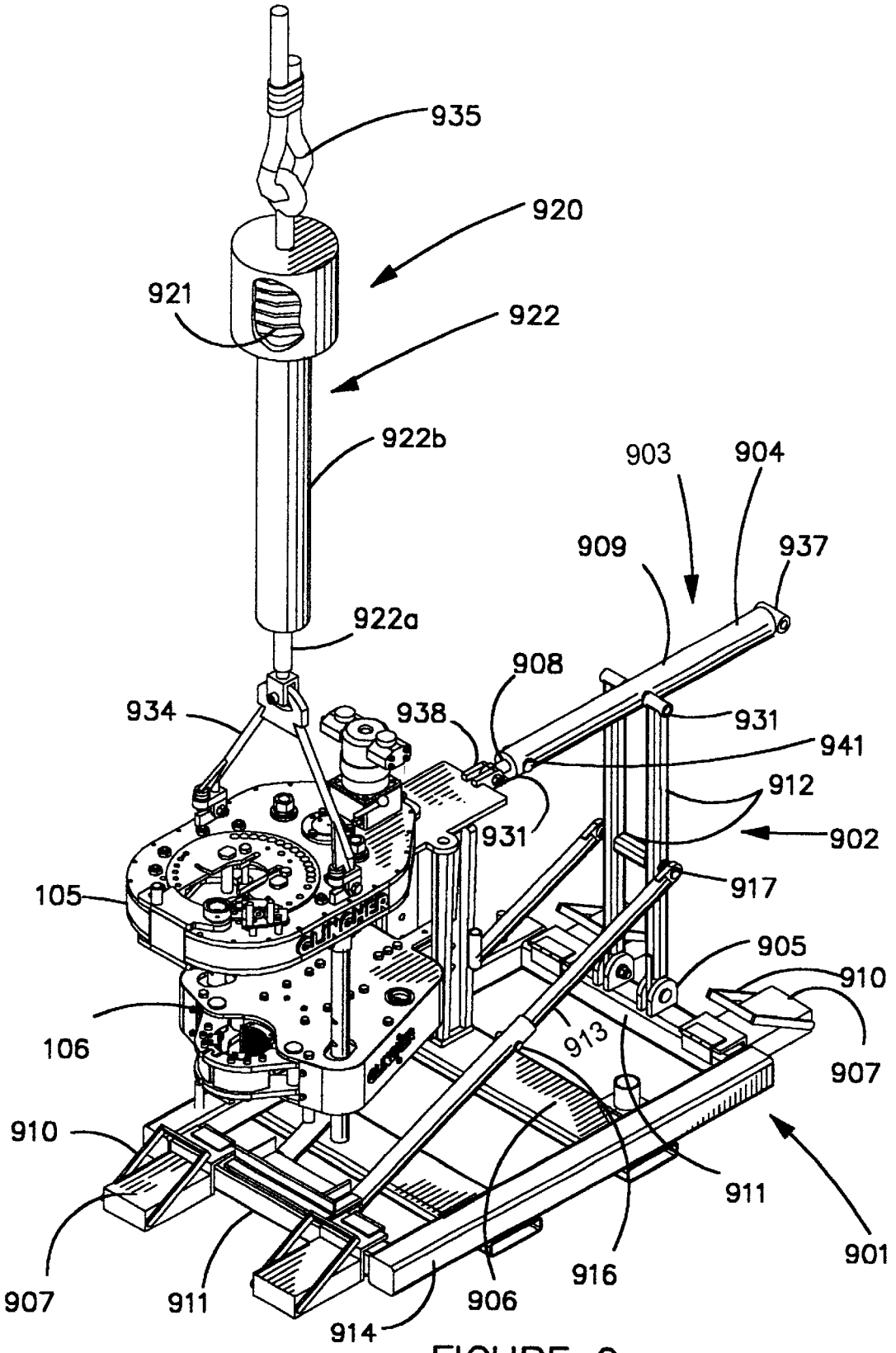
FIG. 9 illustrates a third embodiment of the tong positioning apparatus.

In the embodiment of FIGS. 9–12, positioning apparatus 900 is similar to previous embodiments in that it generally comprises (as best seen in FIG. 9) a frame 901, a base 902, and a tong support 903. Frame 901 includes end beams 911, side beams 914 and cross beams 906 extending between opposing side beams 914. The beams comprising frame 901 will generally have a tubular cross-section and be connected to one another by welding, bolts or other conventional mechanisms. One or more magnets 907 connect to frame 901 so that magnets 907 engage the metallic drilling rig deck on which frame 901 is positioned and fix frame 901 relative to the drilling deck. In the embodiment shown, magnets 907 are selectively releasable from the rig deck by operation of release handles 910. The Handle 910 releases the magnet by using the leverage of the handle to operate a cam mechanism which lifts one end of the magnet and breaks the magnet's grip on the deck. Such selectively releasable magnets are available under the designation "Lift Magnets" from Magnetic Products, Inc., located at 683 Town Center Dr., Highland, Mich. 48357. While the embodiment shown in the figures uses magnets to secure frame 901 to the deck, it will be understood that any other effective means for preventing lateral movement of frame 901 on the deck is well within the scope of the present invention. Thus, by way of example only, frame 901 could be tack-welded to the deck. Alternatively, beams or tubing could be placed on the deck between frame members 911 or 914 and some securely fixed object on the drill deck, thereby allowing any lateral force on frame 901 to be transferred to and resisted by the securely fixed object.

Figure 10:
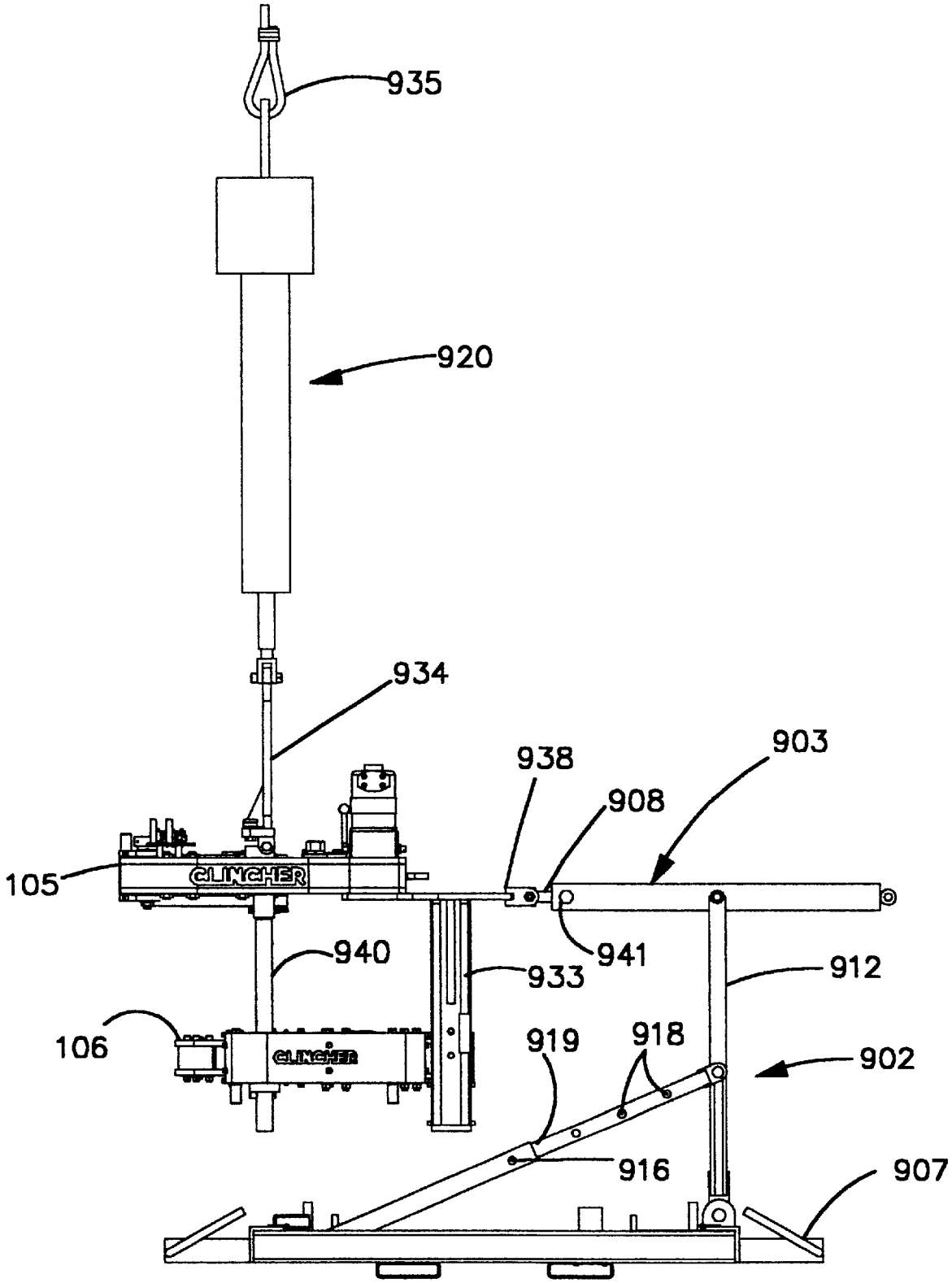
FIG. 10 is a side view of the embodiment seen in FIG. 9.

Base 902 will generally comprise upright supports 912 and extension arms 913. The lower end of upright supports 912 are pivotally attached to frame end beam 911 by way of pins extending through eyes 905. Extension arms 913 pivotally attach at one end to upright supports by way of pin 917. The opposite end of extension arms 913 are pivotally pinned to eyes 915 (best seen in FIG. 12). As best seen in FIG. 10, extension arms 913 are formed from telescoping arms 919 which may be extended or collapsed by way of positioning pin 916 in one of the several apertures 918.

Turning again to FIG. 9, it can be seen that tong support 903 is connected to upright supports 912 of base 902. As will be explained in further detail below, tong support 903 forms an extension device 904 for imparting horizontal force against tong 105. In the embodiment shown, extension device 904 is a hydraulic ram and cylinder assembly comprising cylinder 909 and ram 908 (only the end of which is shown). Cylinder 909 has a first connection point for pivotal attachment to upright supports 912 in the form of eye 937 position on one end of cylinder 909. Two other pivotal connection points for cylinder 909 are at the end opposite eye 937 and at approximately the midpoint of cylinder 909. In the embodiment shown, these pivotal connections are posts extending from the cylinder or "trunnion" mounts 941 (best seen in FIG. 12). In FIG. 9, cylinder 909 is connected to upright supports 912 by way of middle trunnion mount 941.

FIGS. 9 and 10 best illustrate the conventional suspended power tong configuration with which tong positioning apparatus 900 will be utilized. Power tong 105 will be suspended from a conventional vertical positioning assembly 920 which in turn is connected to flexible steel cable 935. Vertical positioning assembly 920 comprises a tong bridle 934, vertical positioning hydraulic ram and cylinder assembly 922, and compensating spring 921. It can be seen that tong bridle 934 connects to power tong 105, which is in turn connected ram 922*b* of vertical hydraulic cylinder assembly 922. Cylinder 922*a* is then connected to compensating spring 921, which is connected to cable 935. The components of vertical positioning assembly 920 are available from Superior Manufacturing & Hydraulics, Inc., located at 4225 Hwy. 90 E, Broussard, La. 70518. Those skilled in the art will readily recognize the purpose of hydraulic cylinder assembly 922 is to allow power tong 105 to be moved in the vertical direction. The use of spring 921 is also well known. As a tubular joint is made up, power tong 105 will be pulled downward. Spring 921 prevents the downward force from placing excessive stress on cable 935. Typically, a back-up tong 106 will be used in conjunction with power tong 105. Back-up tong 106 is supported by legs 940 and tong hanger 933 (also available from Superior Manufacturing and Hydraulics) as is known in the art.

Figure 11:
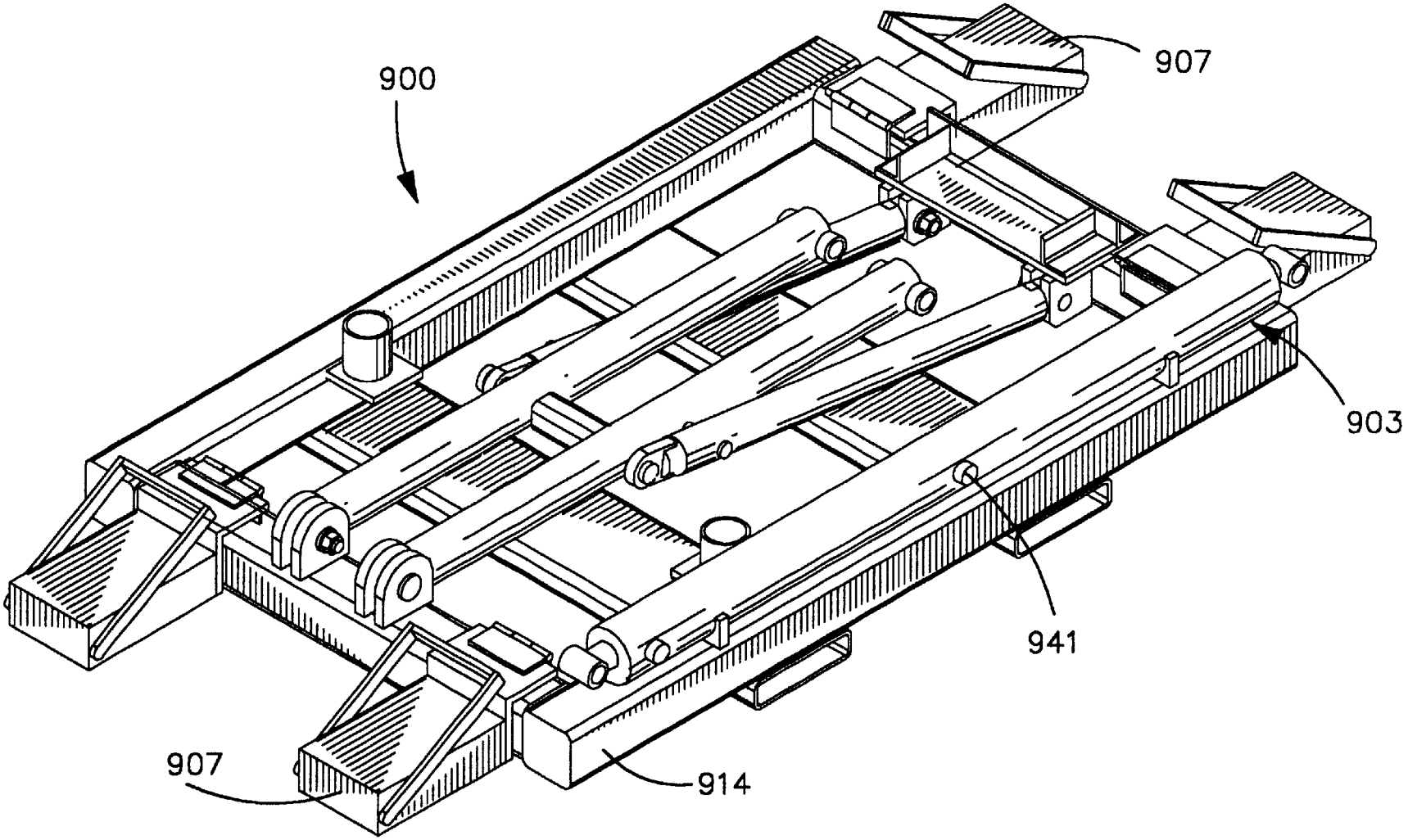
FIG. 11 is a view of the tong positioning apparatus collapsed for transportation.
Figure 12:
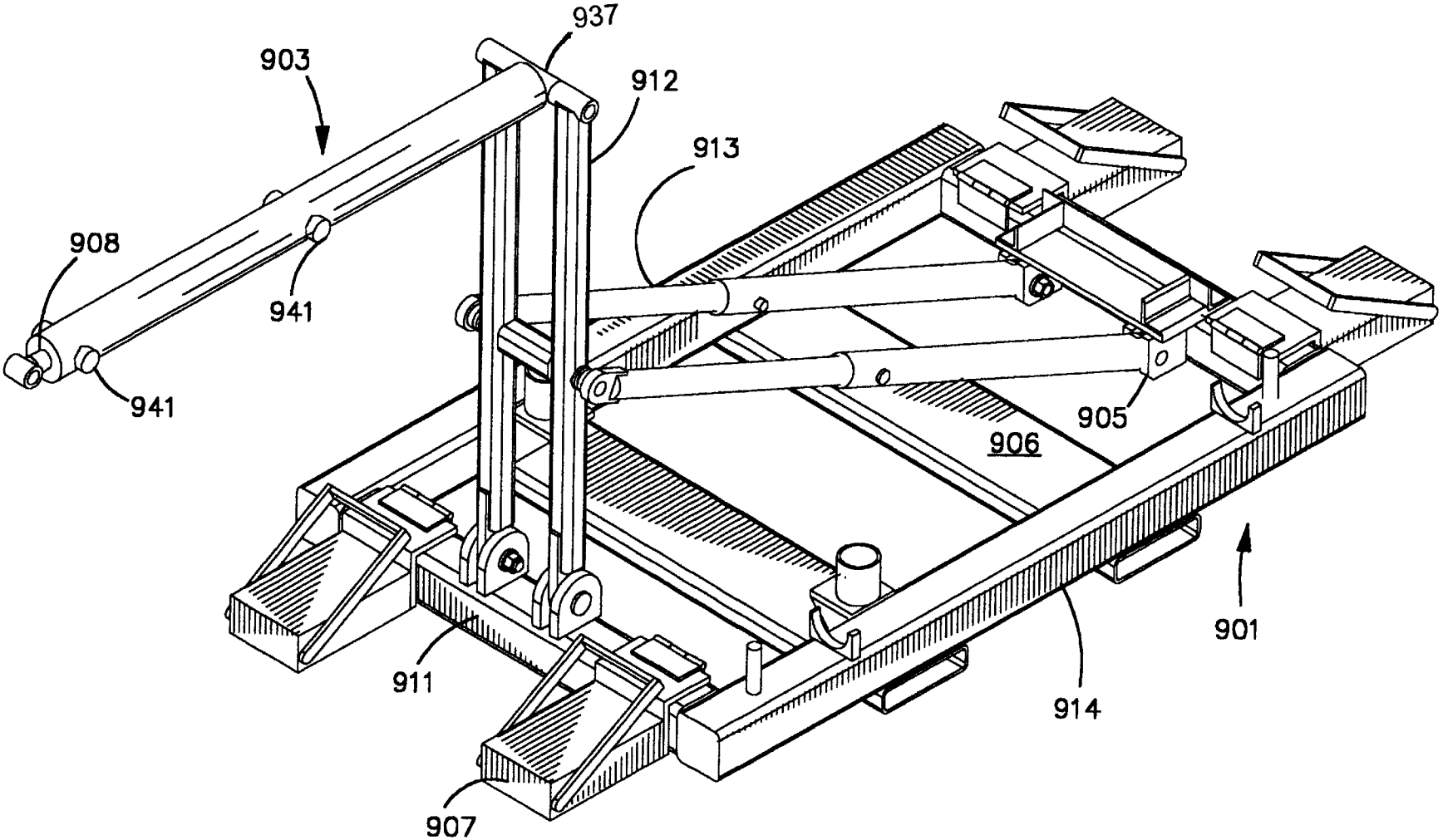
FIG. 12 is a alternate configuration of the tong positioning apparatus seen in FIG. 9.

In the field, tong positioning apparatus 900 typically will be stored and transported in a collapsed state as seen in FIG. 11. When placed into operation, the elements of apparatus 900 will be connected as shown in FIG. 9 and described above. Power tong 105 will be suspended from cable 935 adjacent to the drill string and adjusted to the desired height above the drilling deck by vertical positioning assembly 920. Tong positioning apparatus 900 will be moved to the rear of power tong 105, magnets 907 set to engage the drill deck, and ram 908 pivotally pinned to eye 938 on hanger 933. As it is desired to move power tong 105 and back-up 106 into and out of engagement with the drill string, ram 908 will be extended and retracted from cylinder 909. Naturally, ram 908 could be connected to power tong 105 in many different ways and its connection to hanger 933 is merely illustrative.

FIG. 9 illustrates one operating configuration of tong positioning apparatus 900 where cylinder 909 is connected to upright supports 912 at the midpoint of cylinder 909. This results in power tong 105 being positioned largely over frame 901 when ram 908 is retracted. This is advantageous in the sense that positioning apparatus 900 has a minimum footprint, or takes up the minimum space on the drill deck. The disadvantage of this configuration is that the distance power tong 105 may extend beyond frame 901 is limited. A different configuration seen in FIG. 12 may be obtained by pinning pivot eye 937 on the end of cylinder 909 to upright support 912. While power tong 104 is not shown, it will be understood that this configuration allows ram 908 to extend a connected power tong 104 the greatest distance possible beyond frame 901. The configuration of FIG. 12 would be used, for example, when it was not possible to position frame 901 as closely to the drill string as required by the configuration seen in FIG. 9.

Although the preferred embodiment has been described, it will be appreciated by those skilled in the art to which the present invention pertains that modifications, changes, and improvements may be made without departing from the spirit of the invention defined by the claims.

I claim:

1. A positioning apparatus for positioning a hanging power tong, said positioning apparatus comprising:

a. a frame;

b. a base extending upward from said frame;

c. a power tong support connected to said base, said support including an extension device to horizontally position a power tong.

2. The apparatus according to claim 1, wherein said extension device is pivotally attached to said base.

3. The apparatus according to claim 2, wherein said base is pivotally attached to said frame.

4. The apparatus according to claim 3, wherein said base further comprises:

a. an upright support attached between said frame and said extension device; and b. an extension arm attached between said frame and said upright support.

5. The apparatus according to claim 4, wherein said extension arm is a telescoping arm.

6. The apparatus according to claim 1, wherein said extension device comprises a hydraulic ram and cylinder assembly.

7. The apparatus according to claim 1, further comprising a suspended power tong attached to said extension device.

8. The apparatus according to claim 7, wherein said power tong includes a hanger with a back-up tong attached thereto and said extension device is connected to said hanger.

9. The apparatus according to claim 1, further comprising at least one magnet attached to said frame and engageable with a metallic surface upon which said frame is positioned, whereby said magnet substantially fixes the position of said frame in relation to a metallic surface upon which said frame is positioned.

10. The apparatus according to claim 2, further comprising at least one magnet attached to said frame and engageable with a metallic surface upon which said frame is positioned, whereby said magnet substantially fixes the position of said frame in relation to a metallic surface upon which said frame is positioned.

11. The apparatus according to claim 4, further comprising at least one magnet attached to said frame and engageable with a metallic surface upon which said frame is positioned, whereby said magnet substantially fixes the position of said frame in relation to a metallic surface upon which said frame is positioned.

12. The apparatus according to claim 6, further comprising at least one magnet attached to said frame and engageable with a metallic surface upon which said frame is positioned, whereby said magnet substantially fixes the position of said frame in relation to a metallic surface upon which said frame is positioned.

13. A system according to claim 9, wherein said magnet is a selectively releasable magnet.

14. A system according to claim 4, wherein said extension device have pivotal connection points at each end of said extension device and at approximately a center of said extension device.

15. A system for positioning a power tong comprising:

a. a power tong suspended by a flexible attachment means above a drilling deck;

b. a positioning apparatus located adjacent to said tong and comprising:

i. a frame;

ii. a base positioned on said frame; and iii. an extension device connected to said base and engaging said power tong.

16. A system according to claim 15, wherein said extension device is a hydraulic cylinder.

17. A system according to claim 15, wherein said frame includes at least one magnet securing said frame to said drilling deck.

18. A system according to claim 15, wherein said extension device is pivotally connected to said base and pivotally connected to said power tong.

19. A system according to claim 15, wherein said base further comprises an upright support extending from said frame and a telescoping arm attached between said frame and said upright support.

20. A system according to claim 15, wherein said power tong includes a hanger with a back-up up tong attached thereto and said extension device is connected to said hanger.

21. A system according to claim 17, wherein said magnet is a selectively releasable magnet.

22. A power tong positioning apparatus comprising:

a frame having structural members forming an interior area within said frame;

a power tong support movably connected to said frame such that said support structure may extend substantially out of said interior area and retract substantially within said interior area; and an extension device pivotally connected to said support structure.

* * * * *